United States Patent [19]

Andrews et al.

[11] 3,954,471

[45] May 4, 1976

[54] PHOTOGRAPHIC FIXING PROCESS

[75] Inventors: Timothy Douglas Andrews; Glyn David Short; Jan Willem Frederik van Ingen, all of Runcorn, England

[73] Assignee: Imperial Chemical Industries Limited, London, England

[22] Filed: Sept. 12, 1974

[21] Appl. No.: 505,387

Related U.S. Application Data

[63] Continuation of Ser. No. 281,799, Aug. 18, 1972, abandoned.

[30] Foreign Application Priority Data

Aug. 19, 1971 United Kingdom ..... 38934/71

[52] U.S. Cl. ..... 96/48 R; 96/48 PD

[51] Int. Cl.[2] ..... G03C 5/24

[58] Field of Search ..... 96/48 R, 48 PD, 88

[56] References Cited

UNITED STATES PATENTS

| | | | |
|---|---|---|---|
| 3,623,865 | 11/1971 | Case | 96/48 R |
| 3,642,478 | 2/1972 | Brault et al. | 96/48 R |
| 3,671,250 | 6/1972 | Andrew et al. | 96/88 |

*Primary Examiner*—Won H. Louie, Jr.

*Attorney, Agent, or Firm*—Cushman, Darby & Cushman

[57] ABSTRACT

In an image recording process, a radiation sensitive film comprising a photo-reducible compound is exposed to radiation and subsequently is contacted with a fixing agent capable of being reduced by the reduction product of the photo-reducible compound, with the production of an insoluble coloured material.

7 Claims, No Drawings

PHOTOGRAPHIC FIXING PROCESS

This is a continuation of application Ser. No. 281,799, filed Aug. 18, 1972, now abandoned.

The invention relates to photographic fixing agents for use in conjunction with radiation sensitive materails described in our copending patent applications, e.g. French Patent No. 7019443.

We have already described in detail radiation sensitive materials in which the sensitive component is a salt of the general formula (I)

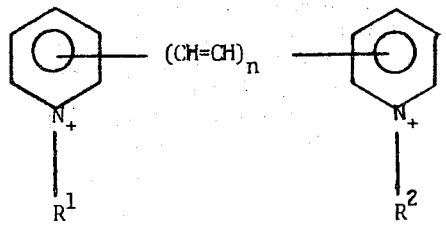

I or ring substituted derivatives thereof where $R^1$ and $R^2$ are hydrocarbon groups or substituted derivatives thereof, $n$ is 0 or an integer and $X^-$ is an anion (preferably of a strong acid of pKa > 2.5).

Examples of suitable salts are compounds containing the following active units.

| Formula | Name |
|---|---|
| 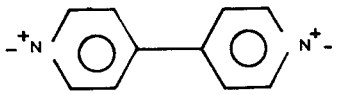 | 4,4'-bipyridylium (P) |
| 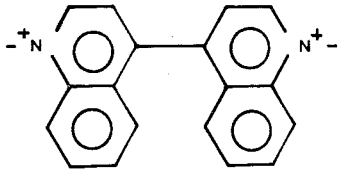 | 4,4'-biquinolinium (Q) |
| 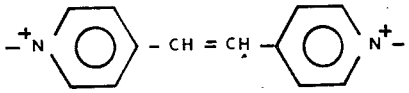 | 1,2-bis(4-pyridyl)ethylene (E) |
| 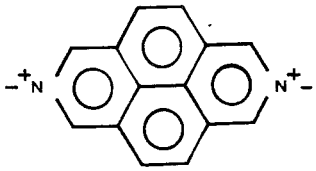 | 2,7-diazapyrinium (A) |
| 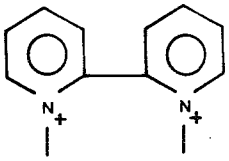 | 2,2'-bipyridyl (B) |
| 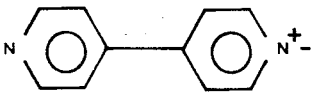 | 4,(4'-pyridyl)pyridinium (M) |

The reference letter following each name will be used in the following description to indicate the appropriate cationic unit to avoid repeating the whole structural formula. Thus $CH_3 — P — CH_3 . 2Cl^-$ represents N,N'-dimethyl-4,4'-bipyridylium chloride. It is implicit in this nomenclature that the $CH_3$ groups are linked to the nitrogen. It is to be understood however that substitution on the carbon atoms of the nuclear unit is possible. Such substituents include alkyl, aryl, aralkyl, alkaryl and oxyhydrocarbyl groups. Of the halogens, chlorine and fluorine may be present, but iodine and bromine are less desirable because they act as quenchers for the excited state of the dication. Fluorescent groups should preferably be avoided, e.g. p-methoxyphenyl groups. It is also desirable that readily reducible groups are absent, e.g. $NO_2$. Therefore when using the symbol P, D, Q etc., it will be clear that as well as the parent compound, suitably substituted derivatives may also be used, e.g. 2,2'-dimethyl-4,4'-bipyridilium compounds.

Confirmation that the dicationic compound is radiation sensitive may be obtained by dissolving 1% by weight of the dicationic compound in a 10% by weight aqueous polyvinyl alcohol solution and then casting a film from this mixture. Exposure of the dried film to ultraviolet radiation of wavelength in the range 200-400 nm causes a colouration which may be blue, green, blue-green, purple or red. Using a test of this type, the following compounds have been found to be radiation sensitive.

R—P—R 2 $X^-$
where R is

| | | | | | |
|---|---|---|---|---|---|
| (1) | $—CH_3$, X = Cl, Br, $SiF_6$, $HSO_4—$, $CH_3SO_4—$ | | (11) | $—CH_2CO$ NH-t-but., | X = Cl |
| (2) | $—CH_2—CH_2-$ 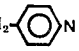 , | X = Cl | (12) | $—(CH_2)CO\ CH_3$., | X = Br |
| (3) | $—CH_2CH_2-$ 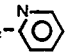 | X = Cl | (13) | $—CH_2CH_2OH$, | X = Cl |
| (4) | 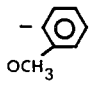 | X = Cl | (14) | $—(CH_2)_nCON$ i-prop, i-prop | X = Cl |
| (5) | $—CH_2CO-$ 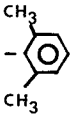 | X = Cl | (15) | $—CH_2CO$ NH- 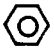 $—OCH_3$, | X = Cl |
| (6) | $-CH_2-$ 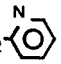 | X = Cl | (16) | $—CH_2COOC_2H_5$, | X = Br |
| (7) | - 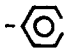 N, | X = Cl | (17) | - 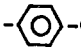 -CN, | X = Cl |
| (8) | $—CH_2CO\ N(C_2H_5)_2$, | X = Cl | (18) | - 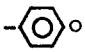 O $CH_3$, | X = Cl |
| (9) | $-CH_2-$ 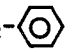 , | X = Cl | (19) | - 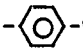 -Cl , | X = Cl |
| (10) | $—CH_2CO$ NH- 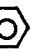 , | X = Cl | (20) | - 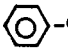 -$OC_2H_5$ , | X = Cl |

(21) 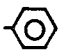 , X = Cl t-but = tertiary butyl
i-prop = isopropyl

-continued

The groups R may be different as in

(22) $CH_3—P$ 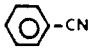 $2Cl^-$ (24) 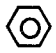 $—OC_2H_5$, X = Cl $M—R'X^-$
where R' is

(23) 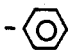 —NH COCH, X = Cl (25) $—CH_3$, X= Cl

Other compounds which have been tested are

(26) $CH_3—Q—CH_3\ (CH_3SO_4^-)_2$ (28) $CH_3—B—CH_3\ (CH_3SO_4^-)_2$

(27) 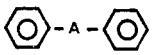 $(BF_4^-)_2$ (29) 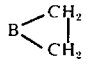 $(Cl^-)_2$

The colours obtained are mainly green to blue and purple, but other colours may be obtained, e.g. compound (26) gives a pink colouration.

Aromatic groups containing halo-methyl side chains are very interesting for forming radiation sensitive compounds containing dicationic nitrogen atoms. Using the bipyridyl molecule as an example, one molecule of a bipyridyl compound may be reacted with two molecules of an aromatic mono halomethyl compound to give a radiation sensitive compound of the type:

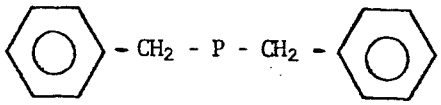

Alternatively one molecule of the aromatic mono halomethyl compound may be reacted with one molecule of a monoquaternised bipyridyl compound such as $CH_3 — P\ X^-$ The product of this reaction is:

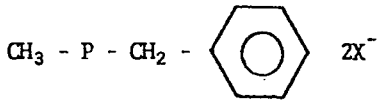

As examples of more complex radiation sensitive compounds, the following have been prepared:

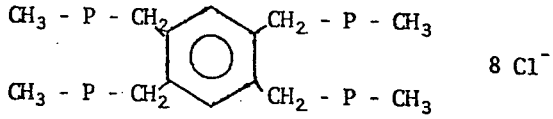

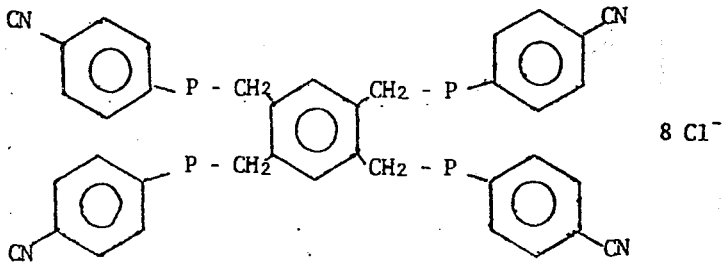

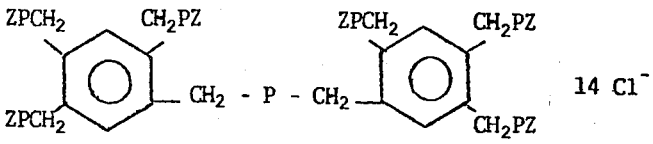

where Z is 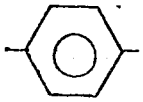 CN or $-CH_3$

The salt is preferably supported in a water soluble or swellable polymer such as gelatin, polyvinyl alcohol or polyvinyl pyrrolidone, optionally cross-linked to insolubilise the polymer as described in our earlier applications.

The radiation sensitivity occurs by partial reduction of the salt in the material to a radical cation or neutral species.

We have described in another patent application (French Patent No. 7042385) how the image formed may be rendered permanent or fixed by treatment with an electroless plating solution.

The present invention provides alternative fixing processes which can be used to produce permanent images of colours which differ from those obtainable by the plating process already described.

Accordingly, the present invention provides a fixing process for use with radiation sensitive materials of the type described above, in which the exposed material is contacted with a solution of a water soluble fixing agent capable of being reduced by a reduction product (formed on irradiation) of a salt of formula I above to form a coloured water-insoluble product.

The reduction potential of the reduction products of salts of formula I is typically in the range +0.2 to −1.0.

One type of fixing agent, which is described in British Patent No. 908,299, are the insoluble formazan dyes which in the oxidised form are water soluble tetraxolium salts of the general formula II or III.

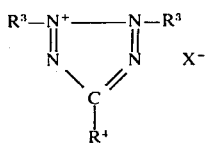

II

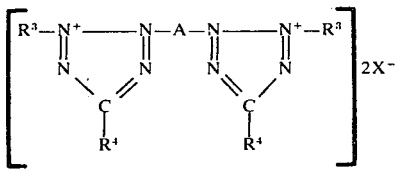

III where $R^3$, is selected from aryl and heterocyclic groups, and A is an alkylene or arylene group and $R^4$ is selected from H, OH, SH, CN, COOH, carboxylic esters, alkyl, aryl and heterocyclic groups and substituted derivatives of the last four.

The soluble tetrazolium salt is dissolved in water at high pH (typically 9 to 13) and the exposed photosensitive material is contacted with it until the desired colour is attained. The unexposed photosensitive material and excess tetrazolium salt can be washed out with water.

Another type of fixing agent is described in British Patent No. 873,054. Cobalt phthalocyanine precursors in acid solution give an insoluble blue image when contacted with exposed radiation sensitive materials of the type described above. The structure of the cobalt phthalocyanine precursors is not well understood, but they may be prepared by reacting hexa-coordinate cobalt compounds with aliphatic polyamines. The references included in British Patent No. 873,054 will assist in preparing a variety of the cobalt compounds. A commercially available fixing agent is Phthalogen Blue 1B (RTM-Bayer AG). Other phthalogenine precursors are described in our copending British Patent Application No. 38933/71, and similarly find application.

A further type of fixing agent is a water soluble ferric salt in which the iron is present as a complex anion and the corresponding ferrous salt is insoluble. Reaction of the ferric salt with the exposed photosensitive material causes reduction to the insoluble ferrous salt in the exposed areas. Excess ferric salt and unexposed photosensitive material may be washed out. Ferric ferricyanide is the most preferred fixing agent of this type.

The concentrations of the fixing solutions, and the duration of contact with the irradiated material can vary within very wide limits. Generally the concentration (dependant upon solubility constraints, of course), will be within the range 0.1–20% usually between 1.0 and 5.0% w/w).

The invention is illustrated by the following Examples.

Example 1

0.5g. Phthalogen Blue 1B (ex Bayer) was mixed with 2 ml. of acetone and warmed until dissolved. The solution was then diluted to 20 mls. with acidified water. A sample of exposed film consisting of 5% N,N′-bis(p-cyanophenyl)-4,4′-bipyridilium chloride in poly(vinyl alcohol) cross-linked with 10% glyoxal coated onto triacetate base to a thickness of 3$\mu$ was placed in the solution for 5 minutes, then removed, washed and dried. The exposed areas (containing N,N′-bis(p-cyanophenyl)-4,4′-bipyridilium chloride radical cation) were found to have been fixed by replacement of the radical with a deposit of blue cobalt phthalocyanine. The photosensitive salt in the unexposed areas was washed out by the fixing treatment, and the cobalt phthalocyanine image is stable.

Example 2

0.5 g. bis(triphenyltetrazolium chloride) is dissolved in 20 mls. of water containing sodium hydroxide to pH 12. A film consisting of 3$\mu$ coating on a triacetate base of poly(vinyl alcohol) - poly(vinyl chloroacetate) copolymer containing 5% N,N′-bis(p-cyanophenyl)-4,4′-bipyridilium chloride is exposed image-wise and treated for 5 minutes in the solution, then removed, washed and dried. The image is found to have changed from the green radical cation colour to magenta, due to reduction of the fixing agent to a formazan dye. As in the above example, unexposed areas are rendered insensitive by this treatment because the dication is washed out.

Example 3

An aqueous solution containing 7.5 g. potassium ferricyanide and 17.5 g. ferric nitrate nonahydrate per liter was prepared. A film prepared by coating a 3$\mu$ layer of low molecular weight poly(vinyl alcohol) cross-linked with 10% glyoxal and containing 5% N,N′-dimethyl 4,4′-bipyridilium methosulphate was exposed image-wise and then immersed in the solution for 5 minutes. The blue radical cation image was replaced with a permanent blue image which had an absorption curve characteristic of Prussian Blue, and the unexposed areas visual density of the film appeared unchanged to the eye, but the printing density onto silver halide photographic paper had more than doubled.

The method of the invention may find application for example in the production of optical sound track.

We claim:

1. A method of forming an image, which comprises the steps of irradiating imagewise a photosensitive material containing a radiation sensitive salt of the general formula

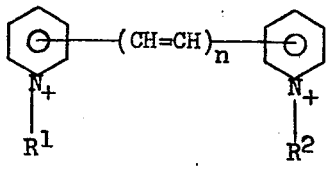

where $R^1$ and $R^2$ are selected from the group consisting of alkyl, aryl, aralkyl, alkaryl and oxyhydrocarbyl groups, $n$ is 0 or an integer and $X^-$ is an anion whereby a reduction product is formed, and contacting the irradiated salt with a solution of a water soluble fixing agent capable of being reduced to a water-insoluble colored product by the said reduction product, said fixing agent being selected from the group consisting of tetrazolium salts, phthalocyanine dye precursors and ferricyanides, for a time sufficient for the formation of such colored product.

2. A method according to claim 1 in which the fixing agent is a tetrazolium salt of the general formula

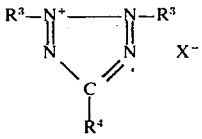

or

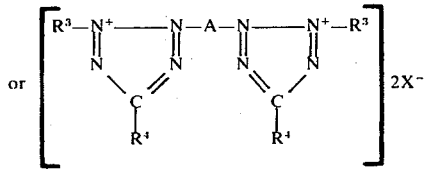

where $R^3$ is selected from aryl and heterocyclic groups, and A is an alkylene or arylene group and $R^4$ is selected from H, OH, SH, CN, COOH, carboxylic esters, alkyl, aryl and heterocyclic groups.

3. A method according to claim 1 in which the fixing agent is a phthalocyanine precursor.

4. A method according to claim 3 in which the fixing agent is a cobalt phthaloxyanine precursor.

5. A method according to claim 1 in which the fixing agent is a water soluble ferric salt in which the iron is present as a complex anion and the corresponding ferrous salt is insoluble.

6. A method according to claim 5 in which the fixing agent is ferric ferricyamide.

7. An image obtained by the method of claim 1.

* * * * *